US006223356B1

(12) United States Patent
Corbin

(10) Patent No.: US 6,223,356 B1
(45) Date of Patent: May 1, 2001

(54) USER SHAPEABLE ELEVATOR BASE FOR TOILETS

(76) Inventor: John H. Corbin, 7608 Fawn Hollow Cove, Austin, TX (US) 78750

( * ) Notice: Subject to any disclaimer, the term of this patent is extended or adjusted under 35 U.S.C. 154(b) by 0 days.

(21) Appl. No.: 09/395,505

(22) Filed: Sep. 14, 1999

(51) Int. Cl.[7] ..... E03D 11/13

(52) U.S. Cl. ..... 4/252.1; 4/252.4

(58) Field of Search ..... 4/252.1, 252.4, 4/252.5

(56) References Cited

U.S. PATENT DOCUMENTS

| | | | | |
|---|---|---|---|---|
| 3,896,510 | * | 7/1975 | O'Connell | 4/252.1 |
| 5,018,224 | * | 5/1991 | Hodges | 4/252.5 X |
| 5,432,957 | * | 7/1995 | Fernie et al. | 4/252.4 |
| 5,987,656 | * | 11/1999 | Kakutani | 4/245.3 |

* cited by examiner

*Primary Examiner*—Robert M. Fetsuga
(74) *Attorney, Agent, or Firm*—Joseph F. Long

(57) ABSTRACT

A foam type elevator base that may be purchased large enough to fit most commodes and that is easily cut with a sharp tool or a hot wire and that is given a finished look using a thin plastic cover fastened adhesively over the edge is disclosed.

3 Claims, 2 Drawing Sheets

USER SHAPEABLE ELEVATOR BASE FOR TOILETS

BACKGROUND OF THE INVENTION

There is a large amount of prior art in the literature but we find none that has a plastic user shapeable elevator base. The standard height of the seat of a normal flush toilet above the floor is about 14 inches.

For use by the elderly and/or partially disabled or to allow tie ins to the commode floor drain an elevator type base is necessary. Since there is some variation in the shape or "footprint" of bases made by different manufactures a user shapeable base gives some economy in manufacture, storage, shipping etc. This patent covers a closed or open cell foam plastic with about a 20 #per square inch or higher load bearing capacity that we have found makes a suitable long lived base for elevating a commode. This foam plastic may be easily shaped to the exact shape of a commode bottom and may be finished with a relatively thin vinyl plastic glued over the cut edge. The foamed base has a further advantage in that the foam base will deform to encompass a small pebble or similar irregularity there by giving solid non-rocking commode installation. Bases may be most any thickness from one to four inches or more. A polystyrene foam has been found to be suitable but other type plastic foams should be equally suitable.

SUMMARY OF THE INVENTION

The invention comprises use of a foamed plastic that has a load bearing capacity of about twenty pounds per square inch and may be easily cut manually using a sharp knife to form an elevator base for a commode. The foam bases may then be sold some what oversized and cut to exactly to conform to various shaped commode bases. The edge of the elevator base may then be covered with a thin plastic to give a finished look to the installation.

DETAILED DESCRIPTION OF THE INVENTION

Figure 1:
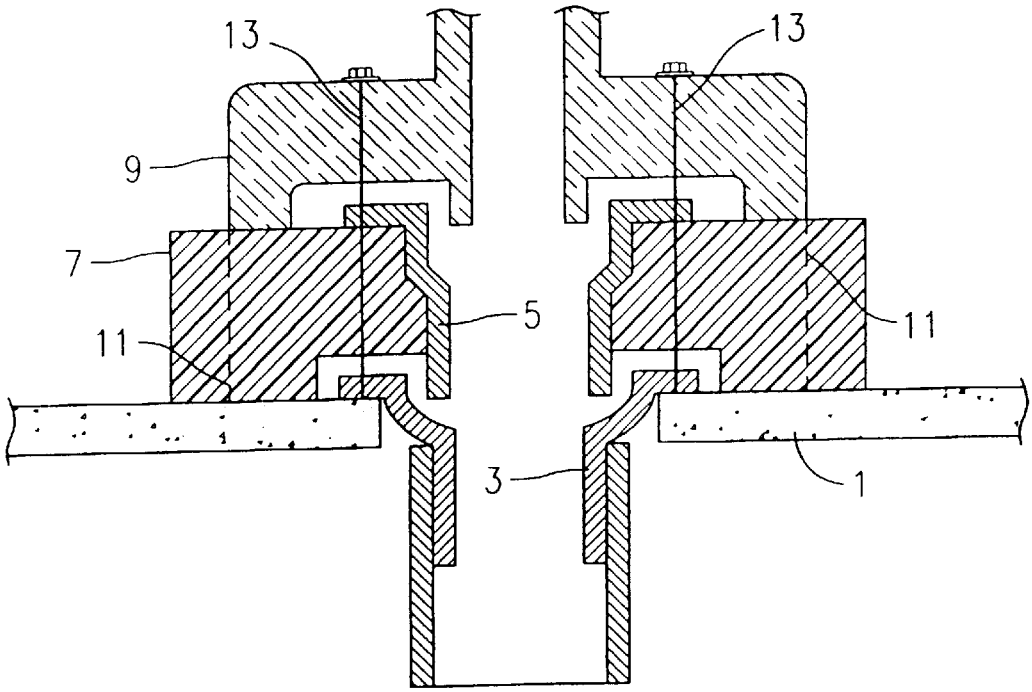
FIG. 1 shows a section view indicating the use of an extension fitting and how the foam base fits under a commode.

FIG. 1 shows a section view of the invention with the usual metal commode plate 3 sitting in floor 1. Foamed elevator base 7 is indicated to be oversize showing trim line 11 to allow manually trimming the foam base 7 to exactly fit under differing sizes of commode bases. Essentially rigid foamed polystyrene has a bout a 20 pound load bearing capacity which is sufficient capacity even for those commodes that have all the load on the one half inch outer rim. The foam has an advantage in that it will deform over sand grains or minor masonry irregularities that many times cause some rocking in a normal non elevated commode. A flange extension or adapter plate hub 5 as thick as the foamed plastic 7 is needed Commode base 9 is bolted down with bolts 13. After trimming along line 11 to have the plastic base 7 to fit exactly under commode base 7 a thin plastic strip 30, FIG. 3, may be adhesively fastened over the cut edge to give the installation a finished look.

Figure 2:
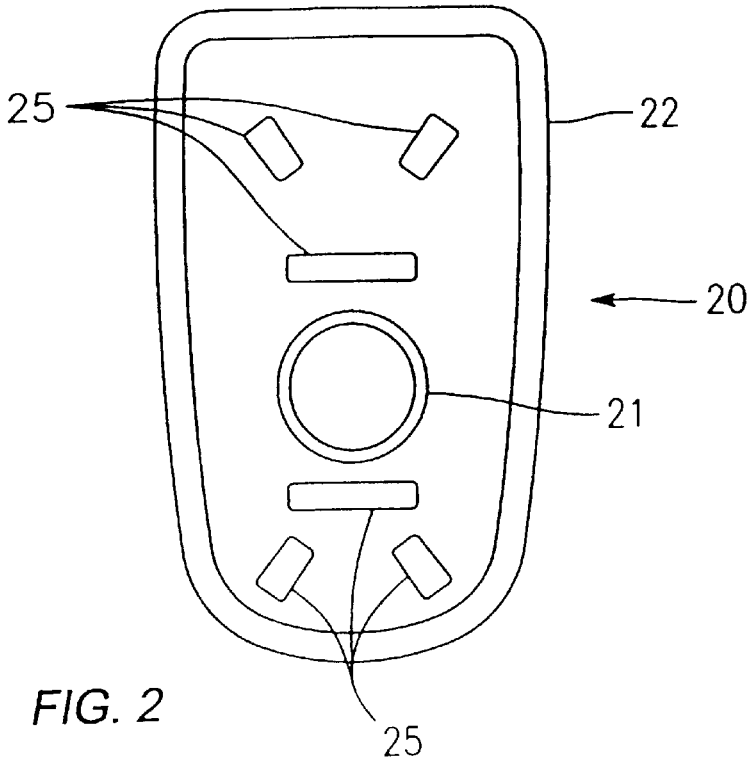
FIG. 2 shows a bottom view of a typical commode indicating several square inches of support area.

FIG. 2 a lower view 20 of a normal commode base with the normal one half inch wide rim 22. Horn 21 would not be load bearing and auxiliary projections 25 may or may not be load bearing; however the one half inch wide rim 22 has ample load bearing surface for foamed plastic as described.

Figure 3:
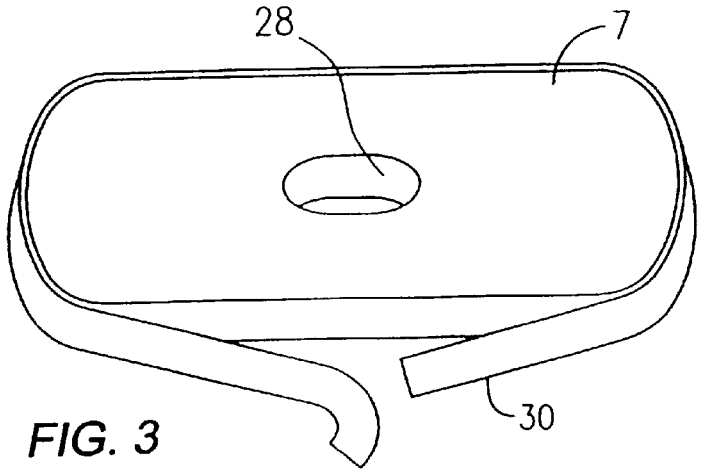
FIG. 3 shows a top view of the foam base indicating an elongated opening to allow some forward and backward movement of the commode over the base.

FIG. 3 shows a top view of base 7 base as sold before trimming along line 11, FIG. 1. Opening 28 may be made to exactly fit the adapter plate hub 5, FIG. 1 because the foamed base 7 is large enough to be trimmed to exactly fit the commode base. A base trimmed and fitted as described has some safety merit in preventing tripping or stumbling against a base extension of the usual type.

What is claimed is:

1. An elevator base for a commode comprising:

a) an essentially rigid foamed plastic with a minimum of twenty pound per square inch load bearing capacity formed to be greater than one half inch thick and sized to be larger than a base of usual makes of commodes;

b) said foamed base being user trimmable to fit exactly under said usual makes of commodes;

c) a thin plastic strip adhesively placed over a foamed plastic edge formed by user trimming of said foamed base.

2. An elevator base for a commode as in claim 1 wherein said foamed plastic is manually trimmable with a sharp knife.

3. An elevator base for a commode as in claim 1 wherein said foamed plastic is manually trimmable using a hot wire.

* * * * *